US006868940B1

(12) United States Patent
Mekwinski

(10) Patent No.: US 6,868,940 B1
(45) Date of Patent: Mar. 22, 2005

(54) SOUND ABSORBING PANEL

(76) Inventor: Julius Mekwinski, 110 Keyes Ct., Sanford, FL (US) 32773

( * ) Notice: Subject to any disclaimer, the term of this patent is extended or adjusted under 35 U.S.C. 154(b) by 32 days.

(21) Appl. No.: 10/425,112

(22) Filed: Apr. 29, 2003

(51) Int. Cl.[7] ..... E04B 1/82

(52) U.S. Cl. ..... 181/290; 181/284; 181/286; 181/291; 181/292; 181/294

(58) Field of Search ..... 181/290, 284, 181/286, 291, 292, 294

(56) References Cited

U.S. PATENT DOCUMENTS 4,425,980 A * 1/1984 Miles ..... 181/208
4,886,696 A * 12/1989 Bainbridge ..... 428/184
5,445,861 A * 8/1995 Newton et al. ..... 428/116
6,209,679 B1 * 4/2001 Hogeboom et al. ..... 181/286

* cited by examiner

*Primary Examiner*—Shih-Yung Hsieh
(74) *Attorney, Agent, or Firm*—Paul S. Rooy, P.A.

(57) ABSTRACT

A sound absorbing panel comprising a standoff layer disposed between a back plate and a screen. The standoff layer supports the screen at a standoff distance from the back plate. The standoff distance is substantially equal to ¼ the wavelength of a sound to be absorbed. An alternate embodiment sound absorbing panel includes a felt layer between the standoff layer and the screen. Another alternate embodiment comprises an apertured membrane supported by standoffs at a standoff distance from the back plate. The standoffs could be any appropriate standoff shape including I standoffs, Z standoffs, and angled standoffs. In one alternate embodiment the apertured membrane is a screen. In another alternate embodiment the apertured membrane is a perforated plate.

15 Claims, 5 Drawing Sheets

SOUND ABSORBING PANEL

BACKGROUND OF THE INVENTION

FIELD OF THE INVENTION

This invention relates to apparatus and methods for acoustic panels, and in particular to a sound absorbing panel.

BACKGROUND OF THE INVENTION

An ongoing and growing problem associated with today's mechanized society is the mushrooming noise pollution that exists in all walks of life. The sound of highway traffic may spill over from the highway into adjoining neighborhoods, creating a constant irritation to the people who live there. Big city traffic sounds, sirens, and honking all contribute to the stress of urban life.

Jet sounds close to airports can actually cause hearing loss to those in close proximity to the jet engines. Concrete blast barriers are typically constructed around engine run-up areas to help protect the hearing of individuals who work or live closeby.

Night clubs which feature live entertainment or loud "canned" music draw many complaints from property owners or nearby residents who suffer from the night club noise late at night, contributing to the health problem of sleep deprivation which already affects many individuals. Some night club owners attempt to solve the problem by installing cheap, Styrofoam insulation, which may be highly flammable. At least one recent night club fire was tragically exacerbated by the rapid combustion of such flammable sound insulation. Thus, it would be desirable to provide acoustic panels which are not only effective, but which are safe.

Existing Designs

In the "high-tech" arena, significant advances have been made in the area of noise attenuation. It has been discovered that not only can unwanted sound be physically blocked by barriers, but that such barriers can actually be designed to absorb sound. Such barriers are typically engineered specifically for the application at hand. For example, sound absorptive devices have been designed and installed in aircraft auxiliary power unit inlets and exhausts, in the International Space Station, in military vehicle exhausts, and in other noise control products in aerospace, military, and industrial applications.

Such products typically require analysis of the specific application, acoustic and mechanical design of the sound absorptive product itself, and finally custom-fabrication of the item. One such product is illustrated in FIGS. 1 and 2. FIG. 1 is a front quarter isometric view of acoustic silencer 2. FIG. 2 is a cross-sectional view of acoustic silencer 2 taken at section II—II of FIG. 1.

As may be observed in FIGS. 1 and 2, acoustic silencer 2 comprises acoustic silencer duct 4 through which intake or exhaust gasses (for an auxiliary power unit, for example) move. Sound associated with the auxiliary power unit exists inside acoustic silencer duct 4 and is absorbed into acoustic silencer 2 as indicated by arrows 14.

Acoustic silencer 2 comprises screen 6, felt layer 8, honeycomb layer 10 and back plate 12. Honeycomb layer 10 serves to offset felt layer 8 and screen 6 away from back plate 12 by a standoff distance 11. It has been determined that an acoustic silencer 2 will absorb sound having a wavelength equal to four times standoff distance 11. For example, 6800 hertz sound has a wavelength of 2 inches.

Therefore, the optimum standoff distance 11 to absorb this sound is ½ inch, because 4 times ½inch=2 inches. Thus, where 6800 hertz sound is to be absorbed, standoff distance 11 would be ½ inch.

The acoustic silencer 2 illustrated in FIG. 2 used a metal screen 6 having approx. 60 wires/inch. Felt layer 8 was a layer of felt. Honeycomb layer 10 was a fiberglass phonetic resin or aluminum, and comprised hexagonal cross-section through passages. Back plate 12 was fiberglass-phenolic, metal, fiberglass-epoxy or carbon fiber-epoxy.

While the acoustic silencer 2 depicted in FIGS. 1 and 2 provided good sound absorption qualities, it was expensive and had to be designed specifically for each application. Accordingly, it would be desirable to provide a sound absorbing panel which could be pre-manufactured to standard sizes, and ready for use in a variety of applications.

SUMMARY OF THE INVENTION

Accordingly, it is an object of the present invention to provide a sound absorbing panel which is manufactured in standard sizes, and is easily mounted for use. Design features allowing this object to be accomplished include a mutually co-extensive screen, felt layer, honeycomb layer, and back plate. Advantages associated with the accomplishment of this object include cost savings due to volume, and the consequent increased availability.

It is another object of the present invention to provide an alternate embodiment sound absorbing panel which is inexpensive to manufacture. Design features allowing this object to be accomplished include a plurality of standoffs attached to a back plate, and an apertured membrane attached to the standoff extremes opposite the back plate. Benefits associated with the accomplishment of this object include reduced sound absorbing panel cost and associated increased availability to the end user.

It is still another object of this invention to provide a sound absorbing panel which will absorb sounds which are commonly sought to be eliminated. Design features enabling the accomplishment of this object include an apertured membrane supported away from a back plate at a standoff distance equal to ¼ the wavelength of the noise to be absorbed. An advantage associated with the realization of this object is the availability of off-the-shelf sound absorbing panels pre-sized to absorb specific sounds, such as traffic sound, for example.

It is still another object of this invention to provide an alternate embodiment sound absorbing panel which is inexpensive to manufacture. Design features enabling the accomplishment of this object include Z standoffs and/or I standoffs which support an apertured membrane away from a back plate. Advantages associated with the realization of this object include cost savings and increased availability.

BRIEF DESCRIPTION OF THE DRAWINGS

The invention, together with the other objects, features, aspects and advantages thereof will be more clearly understood from the following in conjunction with the accompanying drawings.

Four sheets of drawings are provided. Sheet one contains FIG. 1 and 2. Sheet two contains FIGS. 3, 4 and 4A. Sheet three contains FIGS. 5 and 6. Sheet four contains FIGS. 7 and 8.

DETAILED DESCRIPTION OF THE PREFERRED EMBODIMENT

Figure 1:
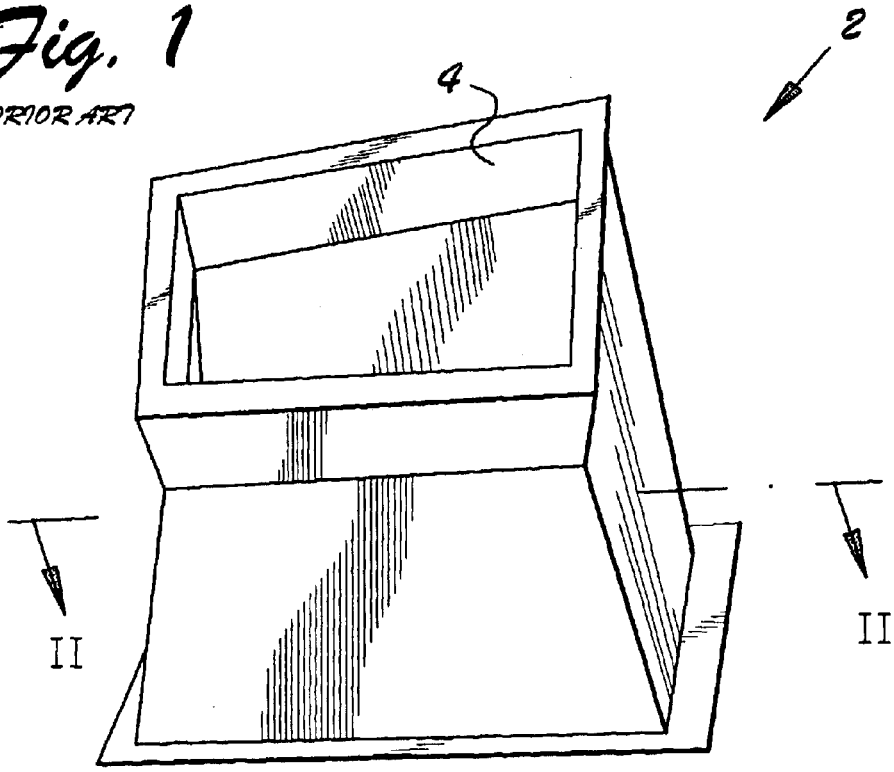
Fig. 1 PRIOR ART
FIG. 1 is a front quarter isometric view of a prior art acoustic silencer.
Figure 2:
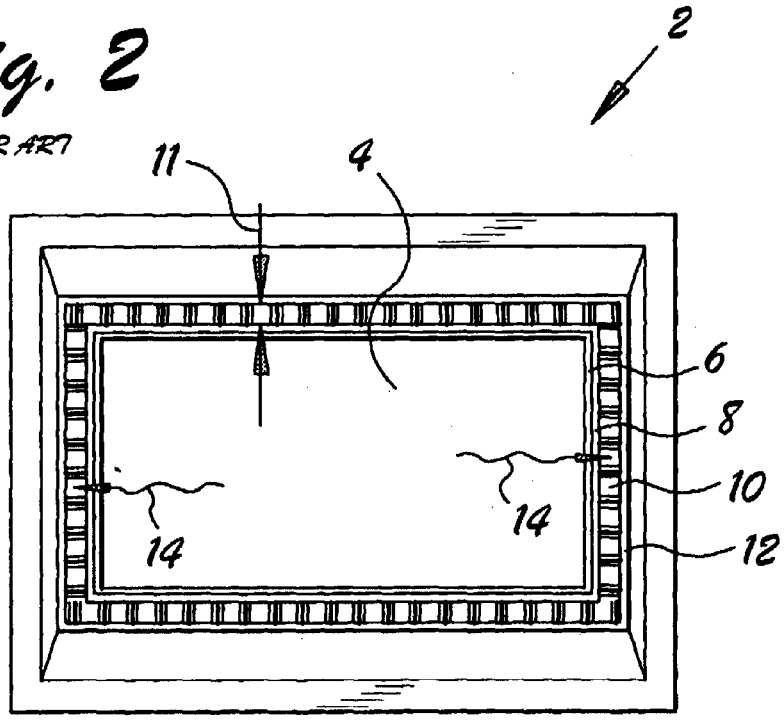
Fig. 2 PRIOR ART
FIG. 2 is a side cross-sectional view of a prior art acoustic silencer taken at section II—II of FIG. 1.
Figure 3:
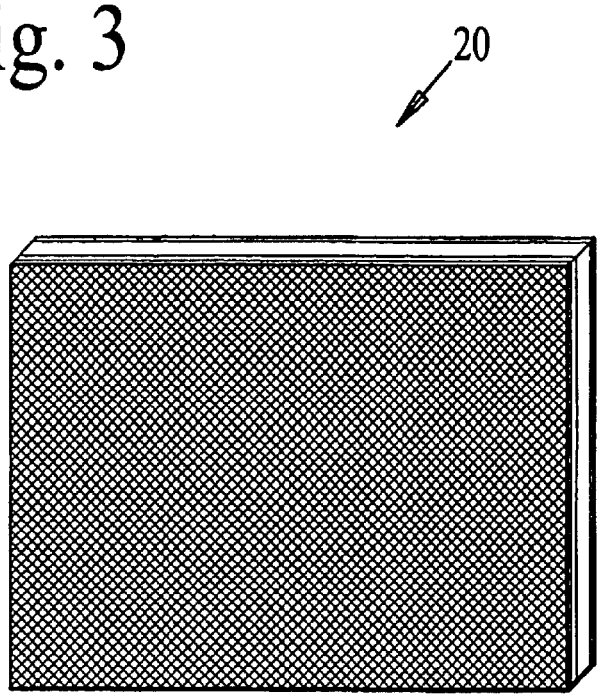
FIG. 3 is a front isometric view of a sound absorbing panel.
Figure 4:
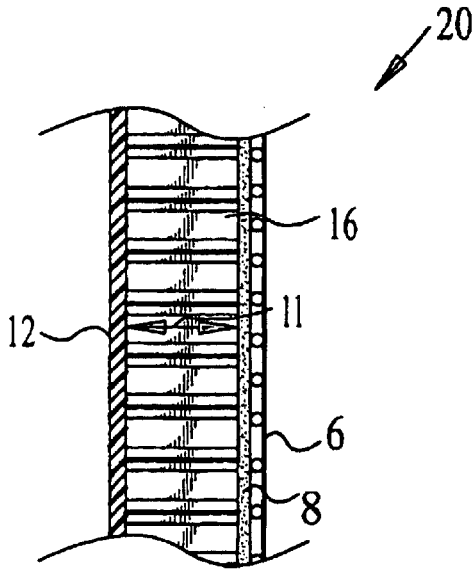
FIG. 4 is a cross-sectional view of a sound absorbing panel.

FIG. 3 is a front isometric view of sound absorbing panel 20. FIG. 4 is a cross-sectional view of sound absorbing panel 20. Sound absorbing panel 20 may be fabricated in a selection of standard sizes, such as 4 feet×8 feet, 5 feet×10 feet, etc. In addition, sound absorbing panel 20 may be manufactured with a variety of different standoff distances 11 for common applications, such as traffic noise absorption, jet engine noise absorption, etc. The guiding rule is that standoff distance 11 should equal ¼ the wavelength of the noise to be absorbed.

Sound absorbing panel 20 comprises back plate 12 attached to one side of standoff layer 16. Felt layer 8 is attached to a side of standoff layer 16 opposite back plate 12, and screen 6 is attached to a side of felt layer 8 opposite standoff layer 16. In the preferred embodiment, standoff layer 16 comprised polygonal cross-section through passages, although any appropriate through passage cross-sectional shape could be employed.

Figure 4A:
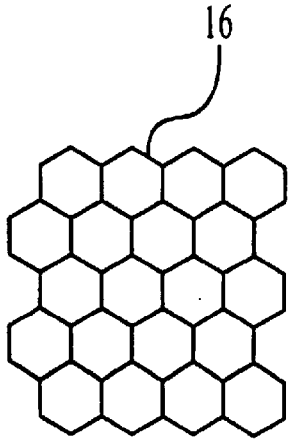
FIG. 4A is a plan view of a standoff layer.

FIG. 4A is a plan view of a standoff layer 16 with polygonal cross-section through passages.

Figure 5:
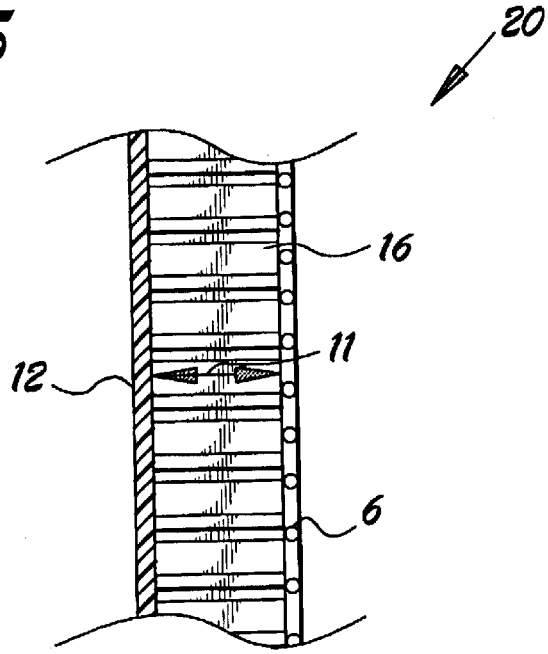
FIG. 5 is a cross-sectional view of an alternate embodiment sound absorbing panel.

FIG. 5 is a cross-sectional view of an alternate embodiment sound absorbing panel 20 which does not incorporate felt layer 8. This embodiment provides cost savings by not requiring felt layer 8, and in addition saves assembly labor time by not requiring the installation of felt layer 8 between screen 6 and standoff layer 16.

Figure 6:
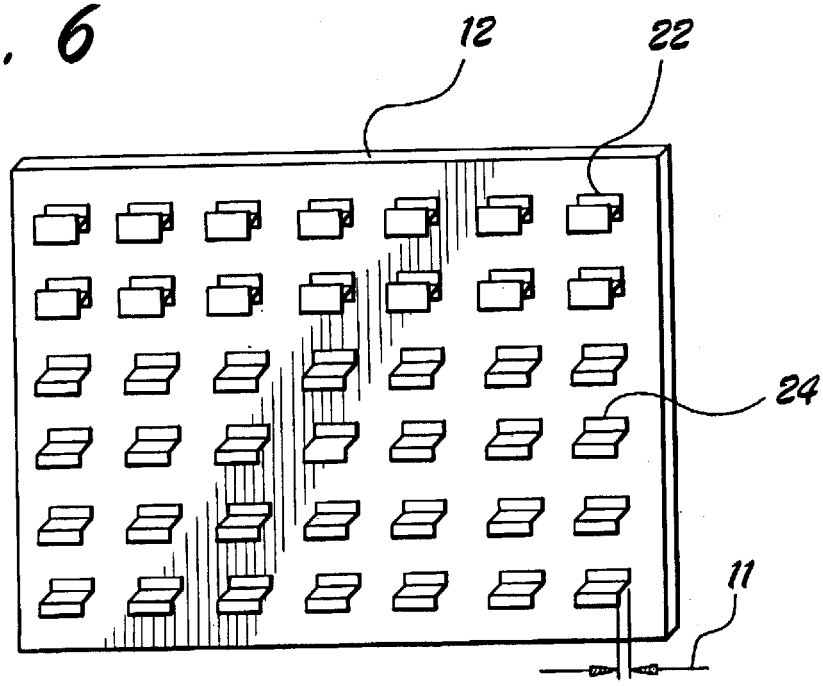
FIG. 6 is a front isometric view of a plurality of standoffs attached to a back plate.
Figure 7:
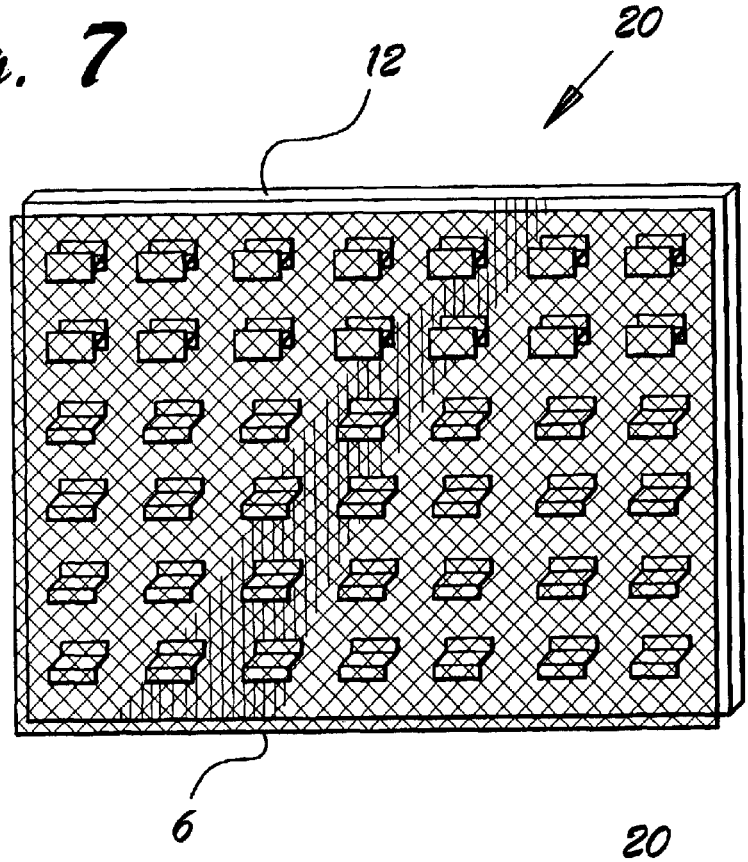
FIG. 7 is a front isometric view of a sound absorbing panel comprising a plurality of standoffs attached to a back panel, and an apertured membrane (a screen, in this case) attached to the extremes of the standoffs opposite the back panel.
Figure 8:
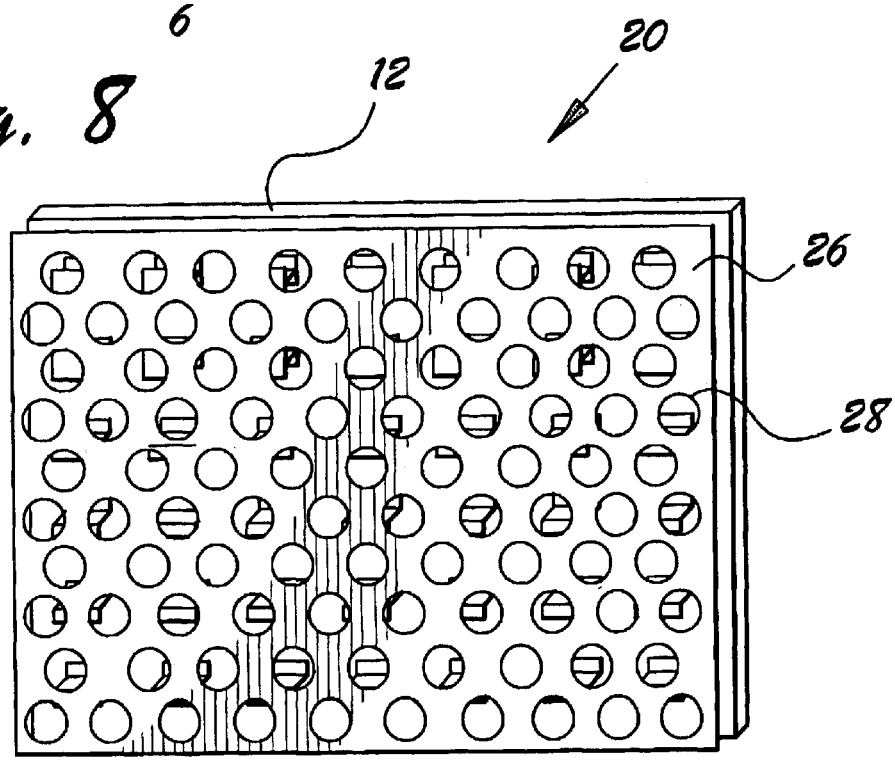
FIG. 8 is a front isometric view of a sound absorbing panel comprising a plurality of standoffs attached to a back panel, and an apertured membrane (a perforated plate, in this case) attached to the extremes of the standoffs opposite the back panel.

FIGS. 6–8 depict alternate embodiments of sound absorbing panel 20 which incorporate a plurality of discreet standoffs 22, 24 to provide the correct standoff distance 11 between an apertured membrane and back plate 12.

FIG. 6 is a front isometric view of a plurality of standoffs 22, 24 attached to back plate 12. The standoffs may be any appropriate shape or cross-section. FIG. 6 illustrates two types of standoffs: I standoffs 22 and Z standoffs 24.

FIG. 7 is a front isometric view of a sound absorbing panel 20 comprising a plurality of I standoffs 22 and Z standoffs 24 attached to back plate 12, and an apertured membrane which is screen 6 attached to the extremes of the standoffs opposite back plate 12. In this alternate embodiment the maximum screen mesh size was 200±100 wires/inch by 800±200 wires/inch.

FIG. 8 is a front isometric view of a sound absorbing panel 20 comprising a plurality of I standoffs 22 and Z standoffs 24 attached to back plate 12, and an apertured membrane which is perforated plate 26 attached to the extremes of the standoffs opposite back plate 12. In this alternate embodiment the preferred perforated plate aperture 28 diameter was 0.050±0.020 inch, and perforated plate 26 was 30%±20% open.

Figure 9:
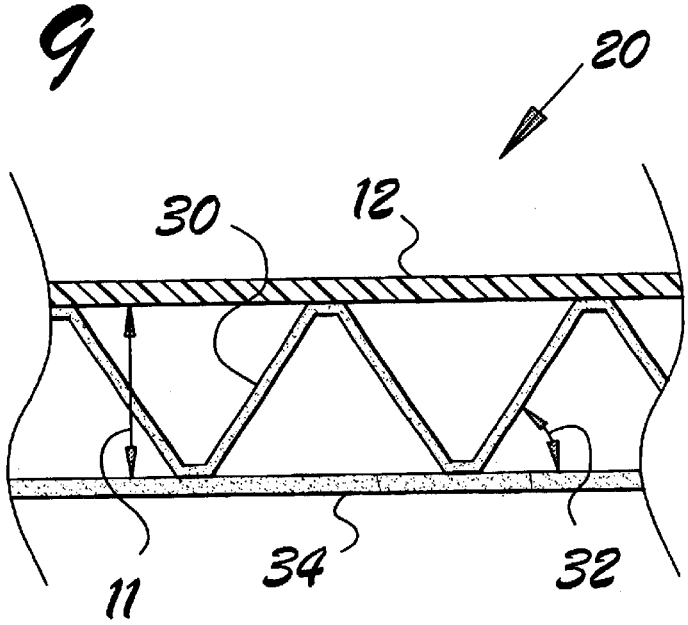
FIG. 9 is a cross-sectional view of an alternate embodiment sound absorbing panel incorporating angled standoffs.

FIG. 9 is a cross-sectional view of a sound absorbing panel 20 comprising angled standoffs 30, which physically attach sound absorptive layer 34 to back plate 12. Angled standoffs 30 are designed to perform two functions. First, angled standoffs 30 act as mechanical support for sound absorptive layer 34 by physically attaching sound absorptive layer 34 to back plate 12. Second, angled standoffs 30 serve as buried septums in order to create standing waves which absorb sound. Traditional buried septums are disposed between, and parallel to, absorptive layer 34 and back plate 12.

In the preferred embodiment, angled standoffs 30 are attached to back plate 12 and sound absorptive layer 34 at an angled standoff angle 32 of 45 degrees±20 degrees. This angle has been determined to be the most effective angled standoff angle 32 to accomplish the dual functions of mechanical support and buried septum angled standoffs 30 cannot be perpendicular to back plate 12 and sound absorptive layer 34 because then they would not function as buried septums, and angled standoffs 30 cannot be parallel to back plate 12 and sound absorptive layer 34 because then they would not function as mechanical supports. Thus, an angled standoff angle 32 of 45 degrees±20 degrees has been determined to be the optimum compromise between angled standoffs 34 being parallel and perpendicular to back plate 12 and sound absorptive layer 34.

In order to fulfill its function as buried septum, angled standoffs 30 should be fabricated of sound absorptive material, which could be the same type of material from which sound absorptive layer 34 is made. Thus, both sound absorptive layer 34 and angled standoffs 30 could be manufactured from felt and metal mesh, wire mesh, metal felt, perforated plate, or any other appropriate sound absorbing material. In order to create the sound-canceling standing waves depicted in FIG. 10, the acoustic impedance (commonly measured in rayls) of the material from which angled standoffs 30 are fabricated should preferably be greater than the acoustic impedance of the material from which sound absorptive layer 34 is fabricated.

Figure 10:
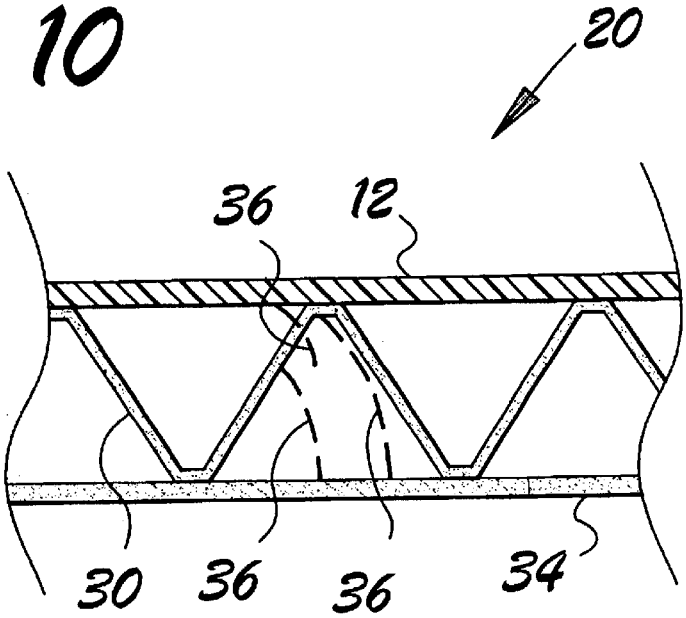
FIG. 10 is a cross-sectional view of the angled standoff sound absorbing panel embodiment showing standing waves generated by this configuration.

FIG. 10 is a cross-sectional view of a sound absorbing panel 20 comprising angled standoffs 30, showing the standing waves 36 which incident sound combined with reflected sound generate in this configuration of sound absorbing panel 20.

While the sound absorbing panel 20 embodiments depicted in the figures are substantially flat, it is contemplated to be within the scope of this invention and disclosure that sound absorbing panel 20 may alternatively be curved.

In the preferred embodiment, screen 6 was made of metal, synthetic, plastic, or other appropriate material. Felt layer 8 was made of felt, fabric, canvas, synthetic weave, fiber, or other appropriate material. Standoff layer 16 was made of fiberglass phonetic resin, plastic, aluminum, synthetic, metal, or other appropriate material. Back plate 12 was made of fiberglass-epoxy, fiberglass-phenolic, carbon fiber-epoxy, plastic, metal, wood, synthetic, or other appropriate material.

While a preferred embodiment of the invention has been illustrated herein, it is to be understood that changes and variations may be made by those skilled in the art without departing from the spirit of the appending claims.

Drawing Item Index

2 acoustic silencer
4 acoustic silencer duct
6 screen
8 felt layer
10 honeycomb layer
11 standoff distance
12 back plate
14 arrow
16 standoff layer
20 sound absorbing panel
22 I standoff
24 Z standoff
26 perforated plate
28 perforated plate aperture
30 angled standoff
32 angled standoff angle
34 sound absorptive layer
36 standing wave.

I claim:

1. A sound absorbing panel comprising a back plate attached to one side of a standoff layer, and a screen attached to a side of said standoff layer opposite said back plate, a thickness of said standoff layer being substantially equal to ¼ the wavelength of a sound to be absorbed by said sound absorbing panel, a maximum mesh size of said screen being 200±100 wires/inch by 800±200 wires/inch.

2. The sound absorbing panel of claim 1 further comprising a felt layer between said screen and said standoff layer.

3. The sound absorbing panel of claim 2 wherein said standoff layer comprises polygonal cross-section through passages.

4. A sound absorbing panel comprising a plurality of individual and discrete Z or I standoffs attached to a back plate, said standoffs being disposed in rows and columns to form a matrix, and an apertured membrane attached to extremes of said standoffs opposite said back plate.

5. The sound absorbing panel of claim 4 wherein said standoffs support said apertured membrane at a distance from said back plate substantially equal to ¼ the wavelength of a sound to be absorbed by said sound absorbing panel.

6. The sound absorbing panel of claim 5 wherein said apertured membrane is a screen.

7. The sound absorbing panel of claim 6 wherein a maximum mesh size of said screen is 200±100 wires/inch by 800±200 wires/inch.

8. The sound absorbing panel of claim 5 wherein said apertured membrane is a perforated plate.

9. The sound absorbing panel of claim 8 wherein said perforated plate comprises a plurality of perforated plate apertures, a diameter of said perforated plate apertures being 0.050±0.020 inch, said perforated plate being 30%±20% open.

10. A sound absorbing panel comprising a plurality of individual and discrete Z or I standoffs attached to a back plate, said standoffs being disposed in rows and columns to form a matrix, and an apertured membrane attached to extremes of said standoffs opposite said back plate, said standoffs supporting said apertured membrane at a distance from said back plate substantially equal to ¼ the wavelength of a sound to be absorbed by said sound absorbing panel.

11. The sound absorbing panel of claim 10 wherein said apertured membrane is a screen.

12. The sound absorbing panel of claim 10 wherein said apertured membrane is a perforated plate.

13. A sound absorbing panel comprising a plurality of angled standoffs attached to a back plate at an angled standoff angle, and a sound absorptive layer attached to extremes of said standoffs opposite said back plate, said angled standoffs being made of sound absorbing material having a sound absorption coefficient of at least 0.5.

14. The sound absorbing panel of claim 13 wherein said angled standoff angle is 45 degrees±20 degrees.

15. The sound absorbing panel of claim 14 wherein an acoustic impedance of material from which said angled standoffs are fabricated is greater than an acoustic impedance of material from which said sound absorptive layer is fabricated.

* * * * *